US005758747A

United States Patent [19]

Okazaki et al.

[11] Patent Number: 5,758,747

[45] Date of Patent: Jun. 2, 1998

[54] MAST SUPPORT FOR FORKLIFT

[75] Inventors: Hiroshi Okazaki; Masanobu Shibuya, both of Kariya, Japan

[73] Assignee: Kabushiki Kaisha Toyoda Jidoshokki Seisakusho, Kariya, Japan

[21] Appl. No.: 633,226

[22] Filed: Apr. 16, 1996

[30] Foreign Application Priority Data

Apr. 25, 1995 [JP] Japan ..... 7-101364

[51] Int. Cl.[6] ..... B66F 9/06

[52] U.S. Cl. ..... 187/227; 187/238

[58] Field of Search ..... 187/227, 226, 187/229, 238; 414/630, 631

[56] References Cited

U.S. PATENT DOCUMENTS 4,657,471 4/1987 Shinodo et al. ..... 187/227

FOREIGN PATENT DOCUMENTS 57-151595 9/1982 Japan .

59-69397 4/1984 Japan .

*Primary Examiner*—Kenneth Noland

*Attorney, Agent, or Firm*—Brooks Haidt Haffner & Delahunty

[57] ABSTRACT

A lift truck having a mast structure for supporting a liftable implement, a pair of lift cylinders for lifting the implement, and a mast support for supporting the mast structure on a front axle of a vehicle body. The mast structure includes a pair of masts extending substantially vertically and a cross beam for connecting the lower ends of the masts. The mast support includes a pair of support bodies fixed to one of the masts and the cross beam at a first fastened section. The mast support further includes a pair of brackets, each bracket being fixed to one of the support bodies at a second fastened section and connected to the front axle. Each cylinder is located adjacent to a corresponding one of the brackets and is located behind the corresponding one of the masts. The structure allows for simplified manufacture.

13 Claims, 5 Drawing Sheets

MAST SUPPORT FOR FORKLIFT

BACKGROUND OF THE INVENTION

1. Field of the Invention

The present invention relates to mast supports of a forklift.

2. Description of the Related Art

Forklifts, such as the type illustrated in FIGS. 5 to 7, are generally used in warehouses and factories to move heavy objects. Such a forklift has a pair of outer masts 31. The bottom end of the masts 31 are connected to each other by a lower beam 32.

A pair of mast supports 33 are welded and fixed to the masts 31 and the lower beam 32. Each support 33 includes a body 34 and a holder 35 with a hole 36 defined between them. By inserting a front axle F of the forklift into the hole 36, the axle F tiltably supports the mast 31 and the support 33. The middle section of each mast 31 is connected to a vehicle body 39 by a tilt cylinder 38 (only one shown). The masts 31 are tilted about the axle F by operating the cylinder 38.

An attaching hole 32*a* is provided near both ends of the beam 32. A lift cylinder S is connected to each hole 32*a* to lift or lower forks 40. The lift cylinders S are located behind the masts 31 to keep them from blocking the driver's frontward view.

The machining of a stepped portion 34*a* in each body 34 of the support 33 causes a portion of the body 34 to become thin. This is necessary to enable the lift cylinder S to be positioned behind the masts 31 and to prevent interference between the cylinder S and the body 34. A reinforcing plate 37 is fastened to the outer surface of the body 34 to strengthen the stepped section 34*a*.

However, in the forklift of the prior art such as the one described above, the machining of the stepped section 34*a* in the body 34 increases production costs.

SUMMARY OF THE INVENTION

Therefore, it is an objective of the present invention to provide a mast support for a forklift that does not block the driver's front view, has sufficient strength, and may be manufactured with low cost.

To achieve the above objective, a lift truck has a mast structure for supporting a liftable implement, a pair of lift cylinders for lifting the implement, and a mast support for supporting the mast structure on a front axle of a vehicle body. The mast structure includes a pair of masts extending substantially vertically and a cross beam for connecting the lower ends of the masts. The mast support includes a pair of support bodies fixed to one of the masts and the cross beam at a first fastened section. The mast support further includes a pair of brackets, each bracket being fixed to one of the support bodies at a second fastened section and connected to the front axle. Each cylinder is located adjacent to one of the brackets and is located behind the masts.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENT

A forklift according to the present invention will now be described with reference to FIGS. 1 through 4. In the same manner as in the prior art, lift cylinders S, which lift and lower the forks, or other implements, are located behind outer masts 1 (behind refers to a rearward direction with respect to the forward moving direction of the vehicle). A front axle F is arranged behind the cylinders S. The lower end of the masts 1 are tiltably supported by the axle F. To simplify description, members having the same structure as in the prior art described above are denoted with the same numerals.

Figure 5:
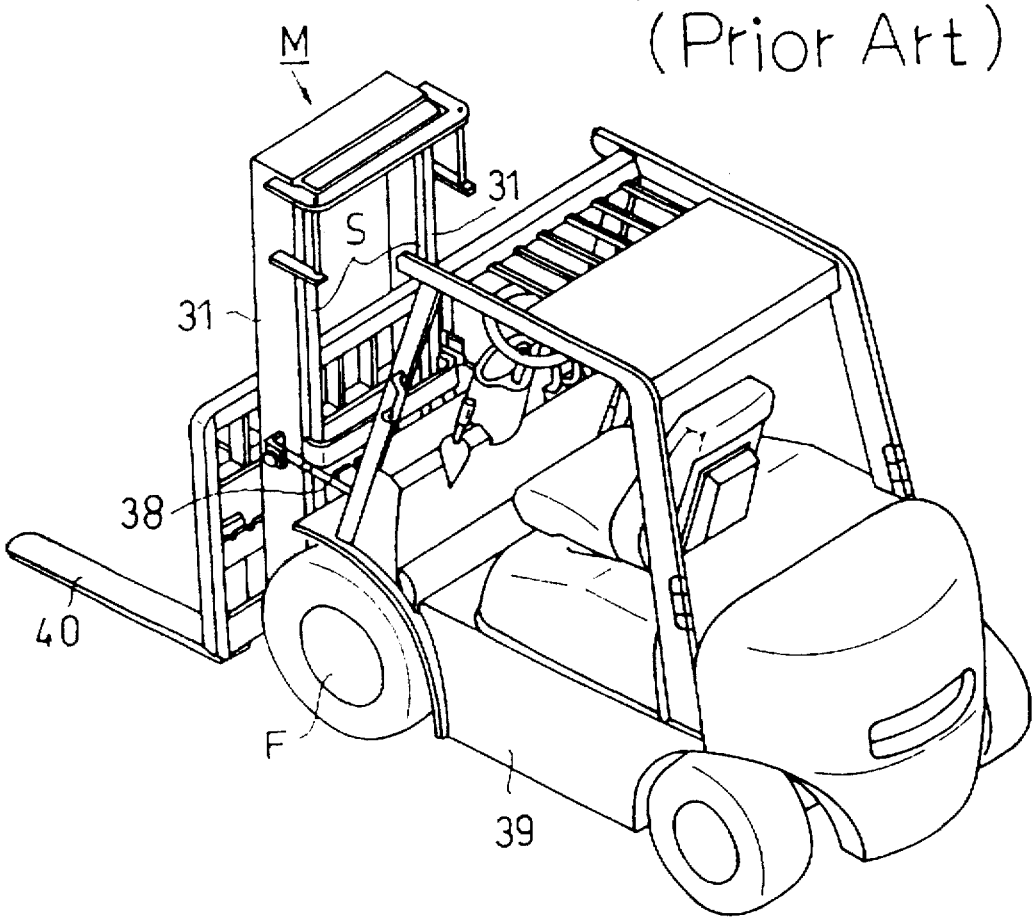
Fig.5 (Prior Art)
FIG. 5 is a perspective view showing a prior art forklift.
Figure 6:
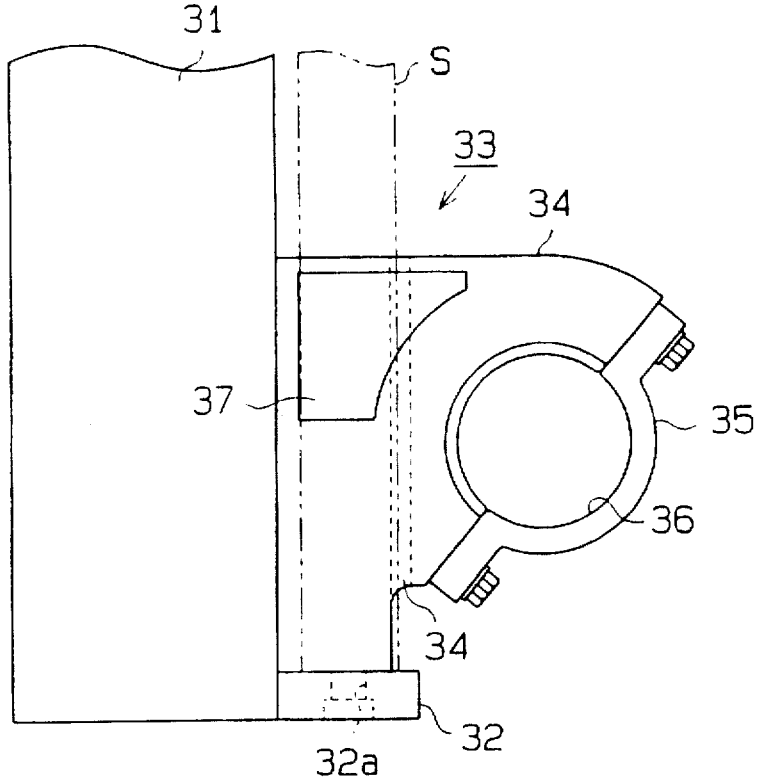
Fig.6 (Prior Art)
FIG. 6 is a side view showing a portion of the mast support of the forklift illustrated in FIG. 5.
Figure 7:
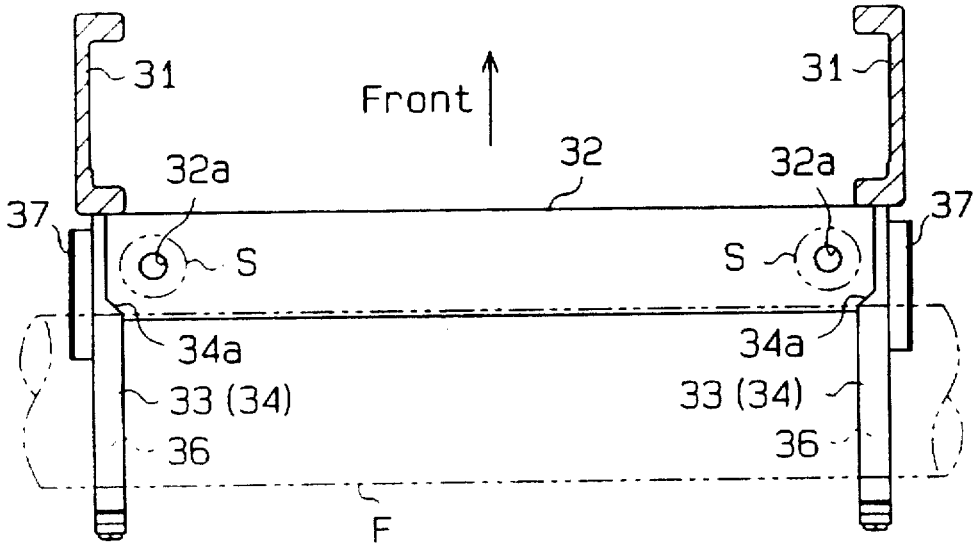
Fig.7 (Prior Art)
FIG. 7 is a partial cross-sectional view taken from above of the mast support illustrated in FIG. 6.

The pair of masts 1 are located in front of a forklift vehicle body 39, as shown in FIG. 5. Inner masts (not shown) which include liftable implements or forks 40 (refer to FIG. 5) for objects to be carried on, are arranged at the inner side of the outer masts 1. The two masts 1 are connected to each other by three cross beams, i.e., an upper beam 2, a tilt beam 3, and a lower beam 4, which are arranged one above the other in the vertical direction at spaced intervals. A connecting pin 5 is provided on each mast 1 near a section where the tilt beam 3 is fastened. The pin enables each mast 1 to be connected to the vehicle body 39 by a tilt cylinder 38 (shown in FIG. 5). The outer masts 1, the inner masts, and the three cross beams 2, 3, 4 constitute a mast structure M.

A hole 6 is provided near each end of the lower beam 4 for the mounting of the respective lift cylinder S. Each lift cylinder S is located behind the associated outer mast 1 to keep it from blocking the driver's front view. A pair of mast supports 7 is provided on the lower beam 4 at the outer side of the holes 6. The supports 7 connect the lower beam 4 to the masts 1 and are rotatably connected to a front axle F (refer to FIG. 3).

As shown in FIGS. 1 through 4, the support 7 includes a support body 8, a bracket 9, and a holder 10. A semi-circular recess 9*a* and 10*a* is formed in the bracket 9 and the holder 10. The fastening of the bracket 9 and the holder 10 with bolts 12 defines attaching recesses 9*a*, 10*a*. The recesses 9*a*, 10*a* rotatably connect the support 7 to the vehicle axle F. A collar 11 is provided in the recess 9*a* of the bracket 9 to allow the support 7 to be rotated smoothly about the axle F.

The support body 8 and the bracket 9 are welded and fixed to each other in a manner such that they are partially overlapped with each other. The outer side of each bracket 9 is welded to the inner side of the associated support body 8. The support body 8 does not have a thin section formed through machining and does not utilize a reinforcing plate. Therefore, the support body 8, having consistent thickness, ensures a wide welding surface.

Each support 7 is fastened to the associated outer mast 1 and the lower beam 4 through welding. The front end surface of each support body 8 is welded to the rear end surface of the mast 1 and the bottom inner surface of each body 8 is welded to the outer end surface of the lower beam 4. The bottom surface of each bracket 9 is welded to the upper surface of the lower beam 4.

Sufficient space is provided on the lower beam 4 to arrange the lift cylinders S behind the mast 1. The cylinders S are arranged adjacent to the section where the bracket 9 is fastened to the support body 8. Chamfers 13 are provided on the front end of the bracket 9 to provide a clearance about the lift cylinders S.

Figure 1:
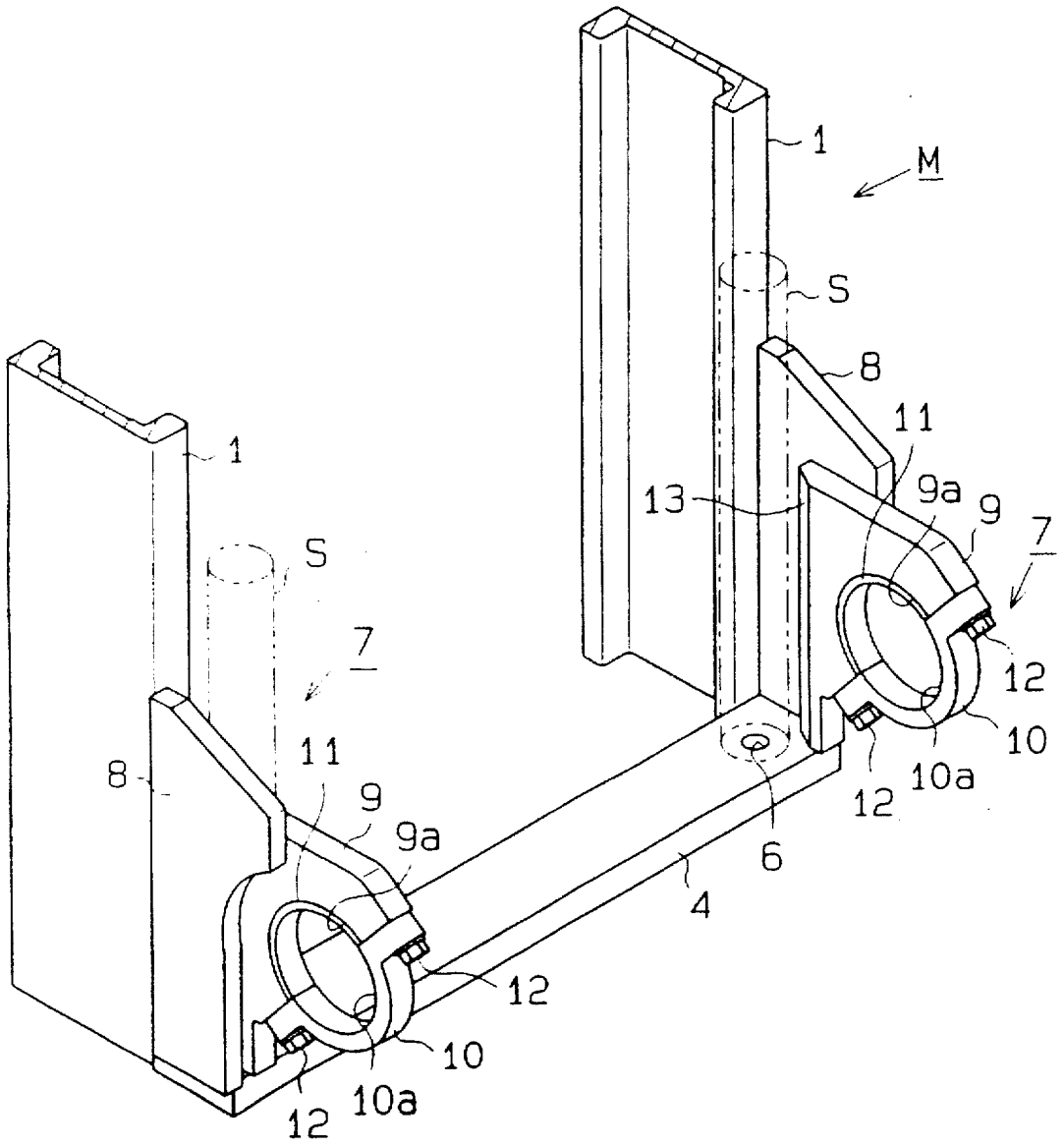
FIG. 1 is a perspective view showing a mast support.
Figure 2:
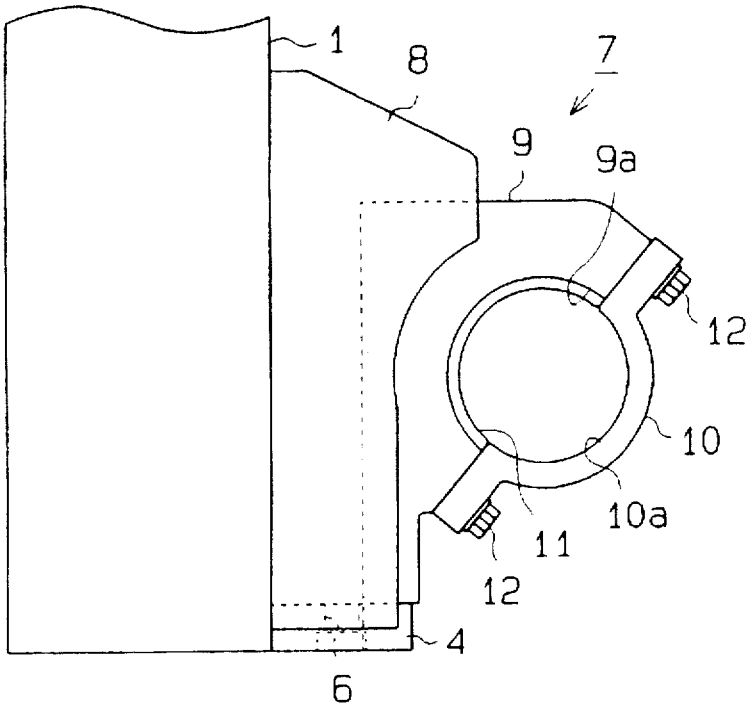
FIG. 2 is a partial side view of the mast support illustrated in FIG. 1.
Figure 3:
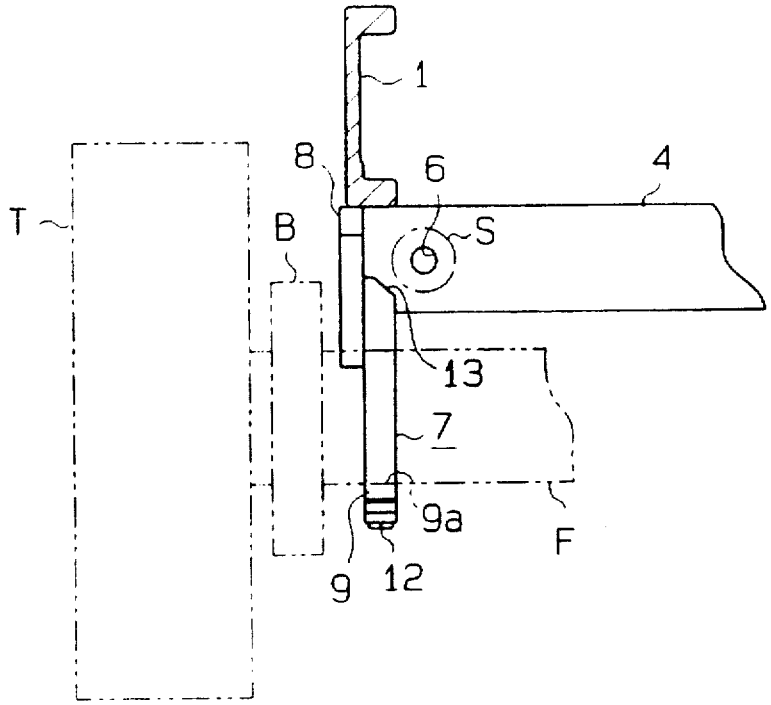
FIG. 3 is a partial cross-sectional view taken from above of the mast support illustrated in FIG. 1.
Figure 4:
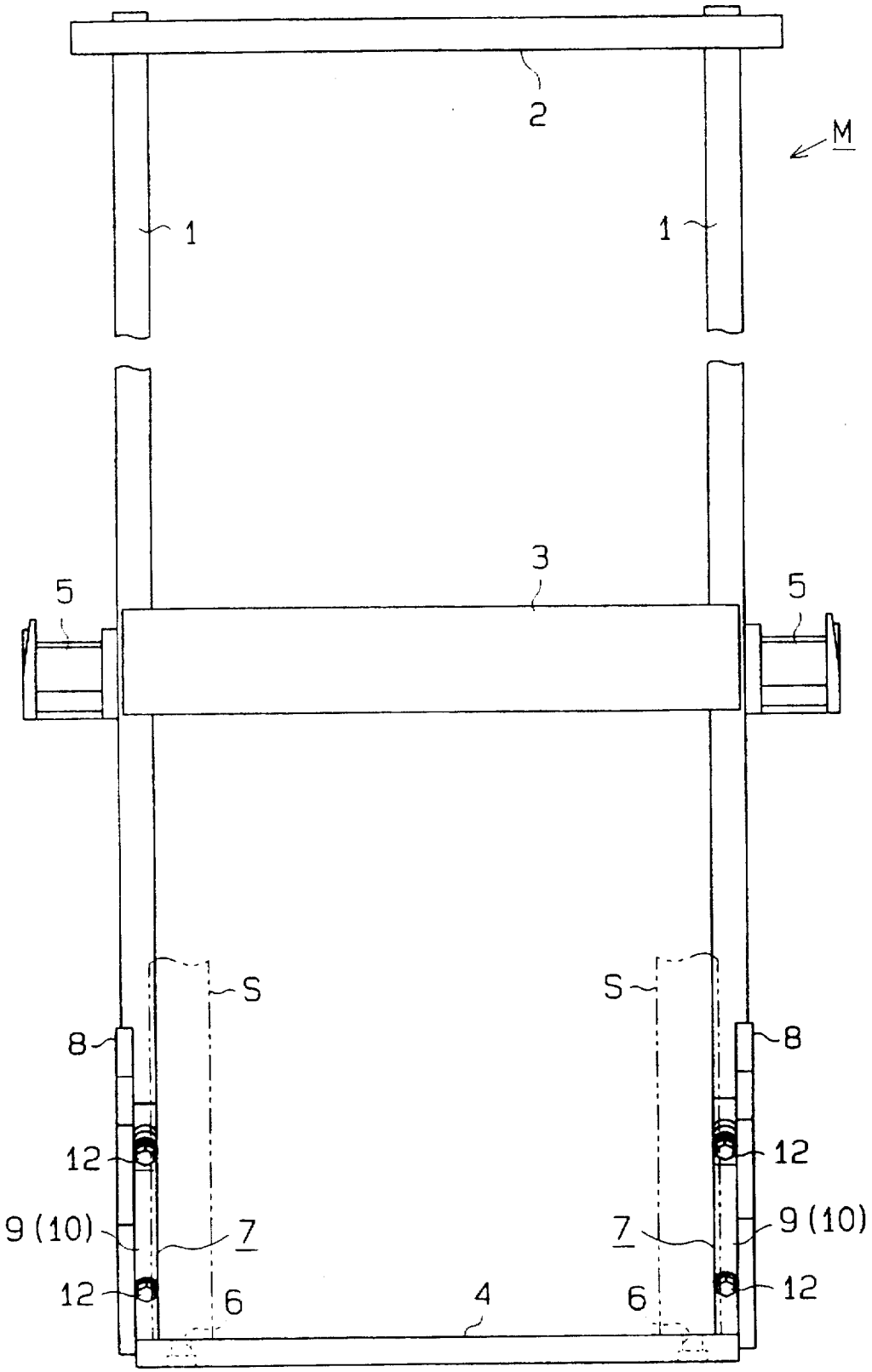
FIG. 4 is a front view showing the outer masts entirely.

A braking device B FIG. 3 is mounted on the front axle F, which is connected to the mast supports 7, at the outer side of the supports 7. A tire T is mounted on the axle F at the outer side of the braking device B.

As described above, each mast support 7 is formed from two members; that is, the support body 8 and the bracket 9, which are fixed to each other by welding. The bracket 9 is fixed to the support body 8 in a manner such that the lift cylinder S is close to the body 8. This prevents interference between the bracket 9 and the lift cylinder S during mounting of the cylinder S and allows the cylinders S to be arranged behind the masts 1. Therefore, the driver's front view is unobstructed.

During manufacturing of the mast support 7, the support 7 does not require machining and thus reinforcing the machined section with reinforcing plates is unnecessary. This allows a large reduction in manufacturing cost. Since the support body 8 is fixed to the bracket 9 by welding them together, which is a relatively simple operation, assembly is simplified.

In addition, the pair of mast supports 7 is provided on the lower beam 4 to locate each bracket 9 at the inner side of the associated support body 8. This enables sufficient space for the mounting of the braking device B and the tire T.

Furthermore, the structure of this embodiment maintains the thickness of the support body 8 and allows the welding area between the mast support 7 and the outer mast 1 to be enlarged. This reduces stress concentration on the welding surface and increases welding strength.

Although only one embodiment of the present invention has been described herein, it should be apparent to those skilled in the art that the present invention may be embodied in many other specific forms without departing from the spirit or scope of the invention. Particularly, it should be understood that the present invention may also be modified as described below.

In the above embodiment, the support body 8 and the associated bracket 9 are fixed to each other through welding. However, the body 8 and bracket 9 may be fastened to each other through other commonly known fasteners such as bolts.

Therefore, the present examples and embodiments are to be considered as illustrative and not restrictive and the invention is not to be limited to the details given herein, but may be modified within the scope of the appended claims.

What is claimed is:

1. A lift truck having a mast structure for supporting a liftable implement, a pair of lift cylinders for lifting said implement, and a mast support for supporting said mast structure on a front axle of a vehicle body, wherein said mast structure includes:

a pair of masts extending substantially vertically;

a cross beam for connecting the lower ends of said masts; and wherein said mast support includes:

a pair of support bodies, each support body having a uniform thickness being fixed to one of the masts and said cross beam;

a pair of brackets, each bracket being fixed directly to the inner face of one of the support bodies and connected to said front axle; and wherein each cylinder is located adjacent to a corresponding one of the brackets and is located behind a corresponding one of the masts.

2. The lift truck according to claim 1, wherein said brackets are connected to said cross beam.

3. The lift truck according to claim 2, wherein said brackets and support bodies are each made of a separate metal plate, and wherein each bracket is overlapped and fixed to its associated support body.

4. The lift truck according to claim 3, wherein each support body is fixed to its associated bracket by means of welding.

5. The lift truck according to claim 3, wherein said brackets are located inside the associated support bodies.

6. The lift truck according to claim 1, wherein said mast structure is tiltably supported on said front axle by said mast support.

7. The lift truck according to claim 6 further comprising a tilt cylinder connected to said vehicle body and said mast structure for tilting said mast structure.

8. The lift truck according to claim 3, wherein each bracket has a front edge located adjacent to each cylinder, said front edge being chamfered.

9. A lift truck having a mast structure for supporting a liftable implement, a pair of lift cylinders for lifting said implement, a mast support for supporting said mast structure on a front axle of a vehicle body, and a tilt cylinder connected to said vehicle body and mast structure for tilting said mast structure, wherein said mast structure includes:

a pair of masts extending substantially vertically;

a cross beam for connecting the lower ends of said masts; and wherein said mast support includes:

a pair of support bodies, each support body having a uniform thickness being fixed to one of the masts and said cross beam;

a pair of brackets, each bracket being fixed directly to the inner face of one of the support bodies and said cross beam and connected to said front axle; and wherein said cylinders are respectively located adjacent to a corresponding one of the brackets and behind a corresponding one of the masts.

10. The lift truck according to claim 9, wherein said brackets and support bodies are each made of a separate metal plate, and wherein each bracket is overlapped and fixed to its associated support body.

11. The lift truck according to claim 10, wherein each said support body is fixed to its associated bracket by means of welding.

12. The lift truck according to claim 11, wherein said brackets are located inside the associated support bodies.

13. The lift truck according to claim 12, wherein each bracket has a front edge located adjacent to each cylinder, said front edge being chamfered.

* * * * *